US011602653B2

(12) United States Patent
Kosmehl et al.

(10) Patent No.: US 11,602,653 B2
(45) Date of Patent: Mar. 14, 2023

(54) METHOD FOR EXTINGUISHING A FLAME FRONT AND EXTINGUISHING DEVICE

(71) Applicant: LEINEMANN GMBH & CO. KG, Braunschweig (DE)

(72) Inventors: Ralf Kosmehl, Lehrte (DE); Frank Helmsen, Peine (DE); Thomas Heidermann, Didderse (DE); Michael Davies, Hildesheim (DE); Tom Gutte, Braunschweig (DE)

(73) Assignee: Leinemann GmbH & Co. KG, Braunschweig (DE)

( * ) Notice: Subject to any disclaimer, the term of this patent is extended or adjusted under 35 U.S.C. 154(b) by 476 days.

(21) Appl. No.: 16/432,030

(22) Filed: Jun. 5, 2019

(65) Prior Publication Data

US 2019/0374801 A1 Dec. 12, 2019

(51) Int. Cl.

| | |
|---|---|
| ***A62C 35/02*** | (2006.01) |
| ***A62C 2/04*** | (2006.01) |
| ***A62C 35/68*** | (2006.01) |
| ***A62C 35/11*** | (2006.01) |
| ***A62C 37/36*** | (2006.01) |
| *A62C 3/00* | (2006.01) |

(52) U.S. Cl.

CPC ..... *A62C 35/023* (2013.01); *A62C 2/04* (2013.01); *A62C 35/11* (2013.01); *A62C 35/68* (2013.01); *A62C 37/04* (2013.01); *A62C 3/00* (2013.01)

(58) Field of Classification Search

CPC .. A62C 4/00–4/02; A62C 35/023; A62C 2/04; A62C 35/11; A62C 35/68; A62C 37/04; A62C 3/00

See application file for complete search history.

(56) References Cited

U.S. PATENT DOCUMENTS

| | | | | |
|---|---|---|---|---|
| 2,626,860 | A * | 1/1953 | Dorf | F23D 14/82 48/192 |
| 6,318,475 | B1 | 11/2001 | Seragnoli | |
| 2015/0238787 | A1* | 8/2015 | Van Gelder | A62C 3/04 169/45 |
| 2016/0361580 | A1* | 12/2016 | Leahy | A62C 35/023 |

FOREIGN PATENT DOCUMENTS

| | | | |
|---|---|---|---|
| CN | 2178128 | Y | 9/1994 |
| CN | 2348870 | Y | 11/1999 |
| CN | 2555062 | Y | 6/2003 |
| CN | 202876161 | U | 4/2013 |
| CN | 104353203 | A | 2/2015 |
| CN | 204815452 | U | 12/2015 |
| CN | 105381559 | A | 3/2016 |
| CN | 105498117 | A | 4/2016 |
| DE | 4126932 | A1 | 2/1993 |
| WO | 2017/070737 | A1 | 5/2017 |

* cited by examiner

*Primary Examiner* — Tuongminh N Pham
(74) *Attorney, Agent, or Firm* — WCF IP

(57) ABSTRACT

A flame front in a gas pipeline is extinguished by introducing an extinguishing agent at an overpressure at an extinguishing zone of the pipeline. Using an overpressure provides a better and finer atomization of the extinguishing agent, and permits a greater amount of the extinguishing agent to be provided in the extinguishing zone per unit time. In addition, a sealing fluid is introduced at sealing zone of the pipeline. Gas flowing through the pipeline must flow through the sealing fluid in the sealing zone. Preferably, movement of a flame front from one side of the sealing zone to the other side of the sealing zone is prevented or reduced by the sealing fluid.

18 Claims, 3 Drawing Sheets

METHOD FOR EXTINGUISHING A FLAME FRONT AND EXTINGUISHING DEVICE

FIELD OF THE INVENTION

The invention relates to a method for extinguishing a flame front in a gas pipeline and, according to a second aspect, an extinguishing device for a gas pipeline.

BACKGROUND

Gas pipelines are transport devices for gases, especially flammable gases. For instance, they refer to pipelines in which gases, such as natural gas, are transported over long distances. However, it may also refer to shorter gas pipelines, such as transport pipes between a refinery and a gas storage tank, or from a transport vehicle to a gas storage tank.

In such gas pipelines, through which flammable gases flow, there is already a risk that the flammable gas will ignite, for example as a result of sparks. Such a spark may occur as a result of faulty electrical devices, such as sensors, or electrostatic discharge. The ignition of the gas in the gas pipeline leads to the formation of a flame front, which spreads in the gas pipeline. This may cause severe damage to the gas pipeline, but also to the area surrounding the gas pipeline.

A particular risk implies that such a flame front reaches a storage tank or a gas transport vehicle, such as a gas tanker, which is connected to the gas pipeline, and causes the volume of gas stored inside to explode. This type of accident may incur enormous material and environmental damages.

Gas pipelines therefore preferably feature devices which prevent such an accident. This may refer, for instance, to extinguishing devices or flame arresters.

Flame arresters are assembly units that are securely installed in the gas pipeline and which comprise a number of through-flow openings, through which the flowing gas can flow, but not the flame. Due to their design, they inevitably increase the flow resistance in a gas pipeline. This means that, for instance, the gas pipelines and the pumps which convey the gas must feature larger dimensions. Specifically, when gases containing contaminants are in use, a flame arrester presents a disadvantage as it becomes polluted by way of the contaminants, which causes a decrease in the through-flow performance. In these types of systems, the flame arresters must be cleaned on a regular basis or replaced.

Extinguishing devices in the form of extinguishing nozzles, for example, are known, by way of which a high-pressure extinguishing agent in sprayed into the pipeline upon the detection of a spark or flame inside the gas pipeline. To this end, pressure cartridges are available, for example, which spray a predetermined amount of extinguishing agent.

Following the development of a flame front in a gas pipeline, there is a general risk that such a flame front will develop again. Faulty electrical components in particular present a high risk of a recurring ignition of the gas. This is especially problematic in extinguishing devices with pressure cartridges, as at least one cartridge is used for each extinguishing operation. Therefore, it is only possible to conduct as many extinguishing operations as there are cartridges available. One way to tackle this issue is to switch off the respective gas pipeline, for example stopping the supply of more gas. However, this prevents gas from flowing through the gas pipeline and as such, the gas pipeline is no longer functional, at least on a temporary basis.

The task of the present invention is to propose a method for extinguishing a flame front in a gas pipeline as well as an extinguishing device for executing this method, thereby enabling a reduction on the above-named disadvantages.

SUMMARY

The invention solves the task by means of a method for extinguishing a flame front in a gas pipeline, wherein the method comprises the steps:

a) introduction of an extinguishing agent at an overpressure into an extinguishing zone of the gas pipeline, and b) introduction of a sealing fluid into a sealing zone of the gas pipeline such that the sealing fluid remains in the sealing zone in such a way that a gas flowing through the gas pipeline must flow through the sealing fluid in the sealing zone.

The flame front should be extinguished by the extinguishing agent. To this end, the extinguishing agent at an overpressure is introduced into an extinguishing zone of the gas pipeline. In the simplest case, this extinguishing zone is a zone inside the gas pipeline in which the extinguishing agent displays an extinguishing effect.

An overpressure should be understood especially to mean a pressure that lies above an atmospheric normal pressure. The extinguishing agent is preferably introduced at an overpressure, in relation to a pressure that is predominant in the gas pipeline during normal operation, which is also described as an operating pressure. Compared to the operating pressure, the overpressure is preferably at least 2 bar, especially preferably at least 5 bar. Compared to an atmospheric normal pressure, the overpressure is preferably at least 10 bar, especially preferably at least 20 bar.

The overpressure renders it particularly possible to use a lower amount of extinguishing agent than would be possible without such an overpressure, given that the overpressure enables a better and finer atomization of the extinguishing agent, such as water, wherein a total surface area of the extinguishing agent in relation to its volume is increased. In addition, a greater amount of extinguishing agent per time unit can be introduced into the gas pipeline. This is beneficial when extinguishing a rapidly developing flame front with a sufficiently large amount of extinguishing agent in a targeted and precise manner. The overpressure is preferably selected in such a way that at least half of the extinguishing agent, in particular the entire extinguishing agent, is introduced into the gas pipeline within 30 milliseconds.

A sealing fluid is also introduced into a sealing zone of the gas pipeline. In the simplest case, the sealing zone is the zone inside the gas pipeline in which the sealing fluid displays a sealing effect. This means that it remains in the sealing zone in such a way that a gas flowing through the gas pipeline must flow through the sealing fluid. The fluid then forms a seal against further flame fronts. A non-flammable fluid, especially water, is preferably used as a sealing fluid. It is possible and, in some embodiments of the invention, advantageous if at least one part of the sealing fluid, in particular all of the sealing fluid, is introduced into the gas pipeline at an overpressure. This allows a sealing effect of the sealing fluid to be produced more quickly. However, the device that may be required to apply the pressure often presents a higher risk of default. It is especially preferable if the sealing fluid is only introduced into the gas pipeline under the influence of gravity.

According to the invention, the sealing fluid remains in the sealing zone in such a way that a gas flowing through the gas pipeline must flow through the sealing fluid in the sealing zone. In particular, it is also in line with the invention if there is mixture or layering of sealing fluid and extinguishing agent, through which the gas must flow. This means that the gas pipeline is completely filled with sealing fluid or with a mixture or layering of sealing fluid and extinguishing agent at at least one point of its cross-section through which fluid can flow. As a result, the gas flowing through the gas pipeline cannot flow past the fluid; rather, it must pass the seal that has been formed in such a way.

On the one hand, this type of seal offers the advantage that a second or further flame front reaching the sealing zone cannot pass through the sealing fluid and/or is extinguished by it. On the other hand, it is also possible that a gas flows through the gas pipeline and the sealing fluid. Therefore, despite an increased flow resistance caused by the sealing fluid, the functionality of the gas pipeline generally remains safeguarded. In this case, it is necessary to observe the specific limits of the through-flow speed and volume for the respective configuration of the extinguishing device.

With the method according to the invention, it is thus possible to operate a gas pipeline without having to ensure the availability of flame protection devices or penetration protection devices which increase the flow resistance. Should an initial flame front occur, it is extinguished with the extinguishing agent. The sealing fluid that has been introduced into the sealing zone serves to effectively prevent a penetration of any further flame fronts that may develop.

The sealing fluid that has been introduced into the sealing zone preferably prevents a movement of a flame front from one side of the sealing zone to the other side of the sealing zone.

The sealing fluid is preferably introduced into the pipeline sequentially after the extinguishing agent.

As a result, the extinguishing agent is first of all introduced into the gas pipeline to extinguish the flame front; the sealing fluid is then introduced into the sealing zone. The fact that these two actions occur consecutively in terms of time should be also understood especially to mean the situation in which the introduction of the extinguishing agent and the sealing fluid partially overlap in terms of time, yet the majority of the sealing fluid is introduced into the gas pipeline after the extinguishing agent.

Specifically, this renders it possible to first extinguish the flame front with the extinguishing agent that has been measured for this purpose and the temporal precision necessary to extinguish it, and subsequently to introduce the sealing fluid, which requires considerably less temporal precision. Additionally, a range of media, especially fluids, can be used as an extinguishing agent and a sealing agent in order to comply with the various requirements.

Preferably, the extinguishing agent is also the sealing fluid.

The extinguishing zone and the sealing zone preferably at least partially coincide spatially; specifically, one of the zones is completely part of the other zone.

The extinguishing and introduction of the sealing fluid preferably occurs in the same zone inside of the gas pipeline. This renders it possible to configure the device required for introducing the extinguishing agent and introducing the sealing fluid as a single assembly, given that they do not have to be arranged at points that are located some distance from one another.

The sealing zone and/or the extinguishing zone preferably lie in a specially designed space within the gas pipeline. For instance, the space is part of a separate extinguishing device that is inserted or integrated into the gas pipeline. Given that, following the extinguishing of the first flame front, the sealing fluid increases the flow resistance, the gas pipeline should be returned to its original state. This is especially easy to achieve if the separate extinguishing device can be replaced. Alternatively or additionally, the space in the gas pipeline which acts as a sealing zone and/or an extinguishing zone comprises a drainage device, through which the sealing fluid can be drained out of the sealing zone. To this end, the gas pipeline should be closed and the flow of gas prevented.

In order to introduce the extinguishing agent into the extinguishing zone a closure is preferably opened, in particular a valve is switched and/or a membrane destroyed.

The overpressure preferably destroys a membrane that fluidically separates the extinguishing agent from the extinguishing zone in order to introduce the extinguishing agent into the extinguishing zone. This is preferably achieved by applying a pressure surge to the extinguishing agent. This may be applied in addition to an overpressure that is already present, the extinguishing agent being at said overpressure.

Regarding a method for extinguishing a flame front in a gas pipeline, a high degree of reliability and a low error rate are extremely beneficial, as a failure of the method may lead to a severe catastrophe. Due to the fact that the extinguishing agent is introduced into the extinguishing zone by applying an overpressure to the extinguishing agent through a thus destroyed membrane, there is a high degree of reliability. In particular, a valve is not necessarily required to introduce the extinguishing agent. Rather, it is preferable if just a pressure surge is applied to the extinguishing agent, said pressure surge being designed to be so strong that it destroys the membrane.

The membrane may be made of a synthetic material, for instance, especially PTFE. However, it is also possible and indeed beneficial in some embodiments for the membrane to be made of a metal or an alloy. This enables, for example, higher pressures in an extinguishing agent container without causing the consequent destruction of the membrane. The membrane is preferably not destroyed until the application of an additional pressure surge. Generally speaking, prior to the activation of the device the extinguishing agent exhibits normal pressure. The extinguishing agent is preferably subjected to a single pressure surge, which destroys the membrane. The membrane preferably features one, preferably several, material weaknesses. These are formed, for example, by micro-perforations of the membrane, which do not have an adverse effect on the impermeability of the membrane for the extinguishing device, by notches in the membrane or zones that exhibit a lower material thickness. Of course, combinations of material weaknesses are also possible. The selection of the type of material weakness and their position in the membrane preferably specify, particularly in a manner that can be reproduced across several membranes, how and where the membrane is destroyed by the pressure surge. In particular, this leads to an increased degree of reliability and operational safety.

According to a further aspect, the invention solves the task by way of an extinguishing device that features at least one container for accommodating an extinguishing device and a sealing fluid and is configured to conduct a method described here.

It is possible and indeed in certain embodiments advantageous if the extinguishing device can be attached to an existing gas pipeline. To achieve this, the extinguishing device is arranged on a gas pipeline, for instance, and the gas pipeline equipped with at least one opening, through which the extinguishing agent and the sealing fluid can be introduced into the gas pipeline. This embodiment is particularly beneficial regarding the simple modification of existing gas pipelines with the extinguishing device according to the invention.

However, it is also possible and in certain embodiments advantageous if the extinguishing device comprises at least one space that is integrated in the gas pipeline and thus forms part of the gas pipeline. If the flame front is extinguished in a space of the extinguishing device, which has become part of the gas pipeline once integrated, this is deemed to be an extinguishing of the flame front in the gas pipeline. The extinguishing device in this example of an embodiment is thus not arranged on the outside of the gas pipeline, but rather integrated inside of it, such that the gas flows through the space of the extinguishing device.

The at least one space of the extinguishing device features at least two openings through which the gas flows from one supply section of the gas pipeline, through the extinguishing device and into a discharge section of the gas pipeline. For the purpose of integrating the extinguishing device, it preferably has a supply flange and a discharge flange, via which the extinguishing device is connected to the supply section and the discharge section of the gas pipeline. Therefore, during gas pipeline operation, the gas flows from the supply section of the gas pipeline, through the at least one space of the extinguishing device and into the discharge section. Once integrated, the extinguishing device thus forms part of the gas pipeline.

The particular advantage of this embodiment is that the at least one space is specially designed and scaled for the functions of the extinguishing device, namely the extinguishing and sealing. As a result, the local circumstances of the gas pipeline are less critical. Specifically, the extinguishing device can be replaced in its entirety, for instance following the execution of an extinguishing event. However, it is also possible that the extinguishing device has a drainage device for the sealing fluid, with which the sealing fluid can be drained out of the sealing zone. This renders it possible, for example, to continue operating an extinguishing device after the conclusion of an extinguishing event, without having to completely replace it. If a membrane has been destroyed for the purpose of introducing the extinguishing agent, this may, for example, be replaced. However, an extinguishing agent container, which comprises the membrane, is preferably replaced in its entirety, such that no works need be undertaken within the extinguishing device itself.

The extinguishing zone and/or sealing zone are/is preferably situated in the at least one space of the extinguishing device. It is especially beneficial if both zones are situated in the same space of the extinguishing device. The opening of the space through which the gas flows in and/or the opening of the space through which the gas flows out preferably lie(s) below a fluid level of the sealing fluid which said sealing fluid develops after having been introduced into the sealing zone. One of the two openings now preferably lies below the fluid level. This guarantees that a gas flowing through the gas pipeline must flow through the sealing fluid in the sealing zone. The fact that the sealing fluid forms a fluid level should also be understood especially to mean that any available extinguishing agent is present along with, especially mixed with, the sealing fluid.

The extinguishing device preferably features at least one container for accommodating the extinguishing agent and at least one container for accommodating sealing fluid. The spatial separation of the two media renders it particularly possible to select different media as an extinguishing agent and a sealing fluid. Furthermore, it is especially easy to allow for a range of volumes.

The extinguishing agent and the sealing fluid are preferably identical fluids, especially water, wherein at least one additive is preferably added to the extinguishing agent and/or the sealing fluid, wherein it is possible to select said additives to be identical in both fluids or to be different. For example, such additives are substances which influence viscosity or density. However, in some embodiments it is also beneficial if the sealing fluid and the extinguishing agent are different fluids or mixtures of different fluids. This renders it possible, for instance, to coordinate them to match the different purposes of the fluids.

The container for accommodating the extinguishing agent, which is also referred to as an extinguishing agent container, is preferably under a pressure when the extinguishing agent has been poured in and the extinguishing device is ready for operation. To this end, the extinguishing agent container is not completely filled, for example, wherein the pressure is exerted by a volume of gas that is present in the extinguishing agent container. This pressure at least partially, in particular fully, determines the overpressure during introduction of the extinguishing agent into the extinguishing zone.

It is especially beneficial if the extinguishing device comprises a pressure generation device, by means of which the extinguishing agent can be subjected to a pressure surge. This refers, for instance, to a gas container with a compressed gas, which can be guided into the extinguishing agent container via a valve, in particular a quick action valve. The pressure generation device preferably refers to a gas generator, as is known, for example, from airbags or similar. In this case, a pyrotechnical propellant with sodium azide or guanidine nitrate, for example, is used.

The extinguishing agent container is preferably only separated from the gas pipeline or the space of the extinguishing device, which is part of the gas pipeline, by a membrane. This membrane is preferably designed as described above.

The at least one container is preferably designed to accommodate the extinguishing agent and the sealing fluid, wherein the container preferably comprises at least one extinguishing agent space and at least one sealing fluid space. The at least one extinguishing agent space and the at least one sealing fluid space are preferably fluidically connected or can be fluidically connected to one another. The extinguishing agent space and the sealing fluid space may also exist without a structural separation.

The extinguishing agent is preferably introduced into the extinguishing zone of the gas pipeline through an opening, which may be sealed by the membrane. As a result of the fluidic connection between the extinguishing agent space and the sealing fluid space, the sealing fluid can also be introduced into the gas pipeline through the same opening. If necessary, the fluidic connection must be created to achieve this purpose.

The extinguishing agent space and the sealing fluid space are preferably separated by a partition wall. This partition wall preferably features one or several valves, which are opened when the sealing fluid is to be introduced into the sealing zone. Alternatively or additionally, the partition wall is pierced and features at least one opening, which creates the fluidic connection between the extinguishing agent space and the sealing fluid space.

Alternatively, the extinguishing agent space and the sealing fluid space may be arranged in two separate structural components which together form the container.

The spatial and structural separation between the extinguishing agent space and the sealing fluid space renders it possible to replace, remove, maintain or clean just one of the spaces.

It is particularly beneficial if the extinguishing agent space is at least partially, but preferably completely, enclosed by the sealing fluid space. Preferably, several sealing fluid spaces are arranged radially around the central extinguishing agent space. The individual sealing fluid spaces are preferably fluidically connected. As a result, it is possible to introduce the extinguishing agent into the extinguishing zone by way of a pressure surge applied to the extinguishing agent in the extinguishing agent space, wherein the sealing fluid subsequently flows out of the sealing fluid space and is thus introduced into the sealing zone. It is thus possible, in a structurally simple manner, to ensure that the pressure surge is only applied to the extinguishing agent space and is done so with the necessary pressure. Furthermore, it is thus particularly simple to ensure that the sealing fluid is introduced sequentially after the extinguishing agent.

The extinguishing agent and the sealing fluid can preferably be activated separately from one another, i.e. they can be introduced separately into the extinguishing zone or the sealing zone.

The extinguishing device preferably comprises at least one detector to be arranged in or on the gas pipeline, wherein the detector is configured to detect a flame front and wherein the extinguishing device comprises an electronic control system, especially an electronic data processing device, which is configured to conduct a method described here depending on detector data of the at least one detector.

For the detection of a flame front, it is beneficial if at least one detector is arranged to detect such a flame front in the gas pipeline. This type of detector refers, for example, to a spark detector or an infra-red flame detector. The at least one detector is preferably arranged, in spatial terms and in relation to a direction of flow of the gas inside the gas pipeline, in front of the extinguishing device. It is particularly beneficial if the extinguishing device features at least two, preferably at least five, detectors which may be specifically arranged at various distances from the extinguishing device in the gas pipeline.

Depending on a detector signal, which for example codes in the event of a detected spark or a detected flame front, the extinguishing device is controlled by the electronic control system; in particular, it triggers an extinguishing event. It is especially preferable if the extinguishing process is initiated depending on a distance of the respective detector from the extinguishing device, said detector having detected a spark or a flame front (translator's note: sentence incomplete in the German source text). It is especially preferable if the propagation speed of the flame front is determined using a time lag between detector signals of different detectors, taking into account the spatial distance of the respective detectors from one another, and the extinguishing process triggered depending on the propagation speed that has been determined as such.

DESCRIPTION OF THE DRAWINGS

In the following, the invention will be explained in more detail by way of the attached drawings. They show FIG. 1—a sectional view through an embodiment of the extinguishing device, FIG. 2—a perspective partial view of the extinguishing device in FIG. 1, and FIG. 3—the extinguishing device from FIGS. 1 and 2, having been integrated in the gas pipeline.

DETAILED DESCRIPTION

Figure 1:
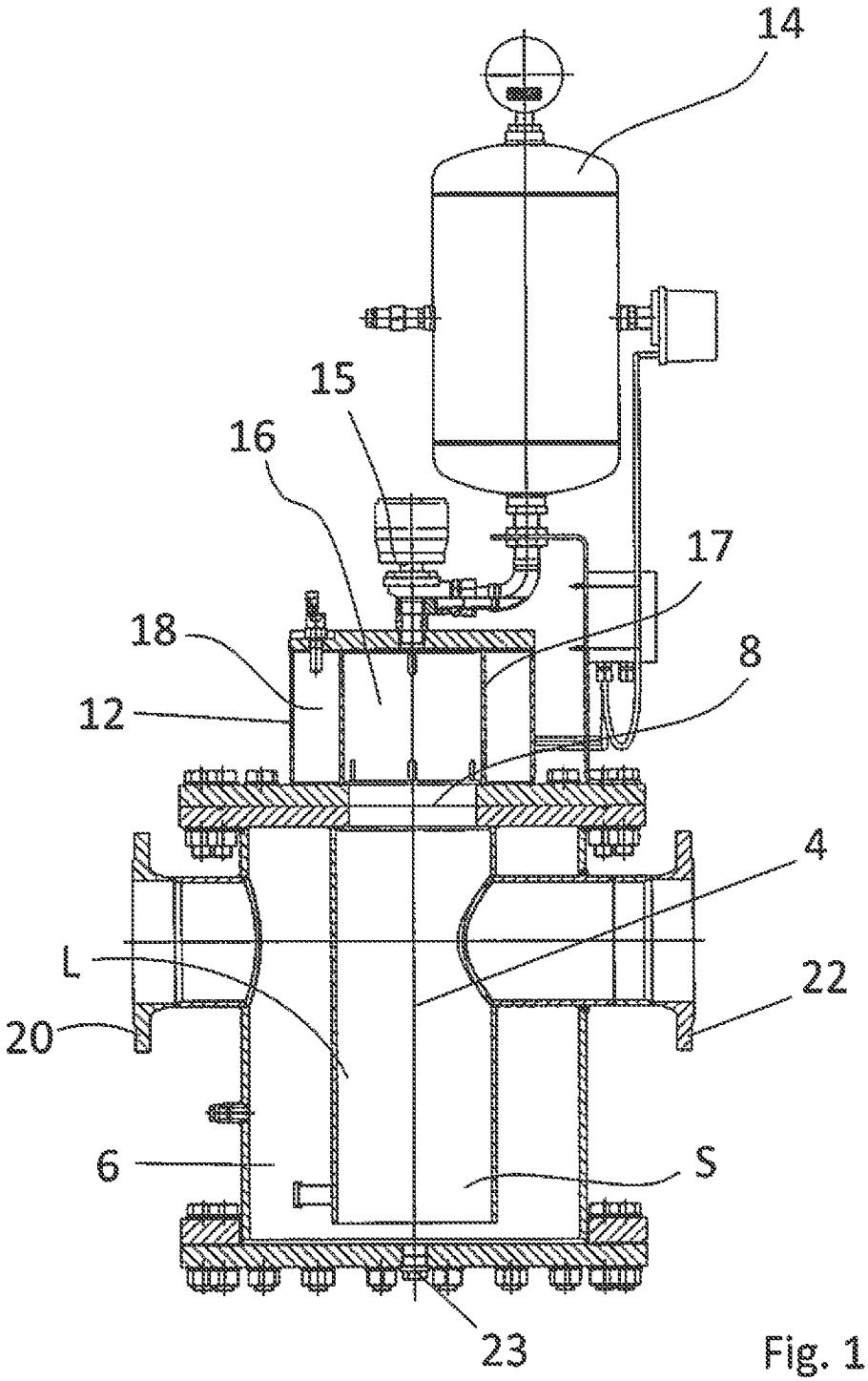

FIG. 1 depicts an example of an embodiment of the extinguishing device 10 according to the invention, which can be integrated in a gas pipeline 2 via a supply flange 22 and a discharge flange 20. During operation, a gas flows through the supply nozzles 22 into an inner space 4 of the extinguishing device 10 and from there enters into an outer space 6. The inner space 4 is designed to be open at the bottom, thereby allowing the gas to flow into the outer space 6. The gas then leaves the extinguishing device 10 via the discharge flange 20. Generally speaking, a flame front moves in the opposite direction, i.e. it enters the extinguishing device 10 through the discharge flange 20 and leaves through the supply flange 22, provided that its progress is not prevented by the extinguishing device 10.

A container 12 is arranged above the inner space 4 and the outer space 6. This container 12 features a central, cylindrical extinguishing agent space 16, which is laterally completely enclosed by a hollow, cylindrical sealing fluid space 18. The extinguishing agent space 16 and the sealing fluid space 18 are separated from one another by a surrounding perforated partition wall 17. As a result of the perforation of the perforated partition wall 17, the extinguishing agent space 16 and the sealing fluid space 18 is constantly fluidically connected.

When the extinguishing device 10 is ready for operation, the extinguishing agent space 16 and the sealing fluid space 18 are filled with a fluid, especially water. Here, the fluid inside the extinguishing agent space 16 is the extinguishing agent and the fluid inside the sealing fluid space 18 is the sealing fluid.

The extinguishing agent space 16 is fluidically separated from the inner space 4 by a membrane 8. This membrane 8 almost completely forms a base area of the cylindrical extinguishing agent space 16. A container of compressed gas 14 is arranged above the container 12. Specifically, the compressed gas inside the container of compressed gas 14 exhibits a pressure of at least 5 bar in relation to an atmospheric normal pressure. The container 14 can be fluidically connected to the container 12 via a pressurized gas pipeline. To this end, a quick action valve 15 is situated inside the pressurized gas pipeline. By opening this quick action valve 15, it is possible to introduce pressurized gas from the container 14 into the extinguishing agent space 16 of the container 12.

As a result of the pressure surge that is applied to the extinguishing agent in the extinguishing agent space 16, the membrane 8 is destroyed and the extinguishing agent enters the inner space 4 at an overpressure. Accordingly, the extinguishing zone L is situated in the inner space 4.

Once the extinguishing agent has entered the inner space 4 through the destroyed membrane 8, the sealing fluid flows out of the sealing fluid space 18, through the perforations of the perforated partition wall 17 and into the extinguishing agent space, and correspondingly also through the destroyed membrane into the inner space 4. The sealing fluid also flows into the outer space 6 through the base opening, by means of which the inner space 4 is fluidically connected to the outer space 6. All remaining fluid in the extinguishing device, i.e. the sealing fluid and any remaining extinguishing agent, forms a fluid level. The volume of the sealing fluid is measured such that the sealing fluid already forms a fluid level in its own right, said fluid level lying above the base opening of the inner space 4. It forms a fluid level of identical height in the inner space 4 and the outer space 6. This goes beyond the base opening of the inner space 4, the result of which being that any gas flowing into the extinguishing device 10 must flow through the fluid. This produces the sealing effect of the sealing fluid against a further flame front.

Aside from any residual volumes of fluid, the container 12 now contains no more fluid. Correspondingly, the container 14 also contains no more compressed gas. In other words, a further extinguishing by means of the extinguishing agent is no longer possible. However, due to the sealing effect of the sealing fluid this is also not necessary.

If the extinguishing device is now to be returned to a state of operational readiness, the sealing fluid may be drained by, for example, a drainage device 23. Subsequently, it is only necessary to replace the destroyed membrane 8, to refill the container 12 with fluid and the refill the container 14 with pressurized gas. Alternatively, the empty container 12 and the empty container 14 can be replaced by filled ones.

Figure 2:
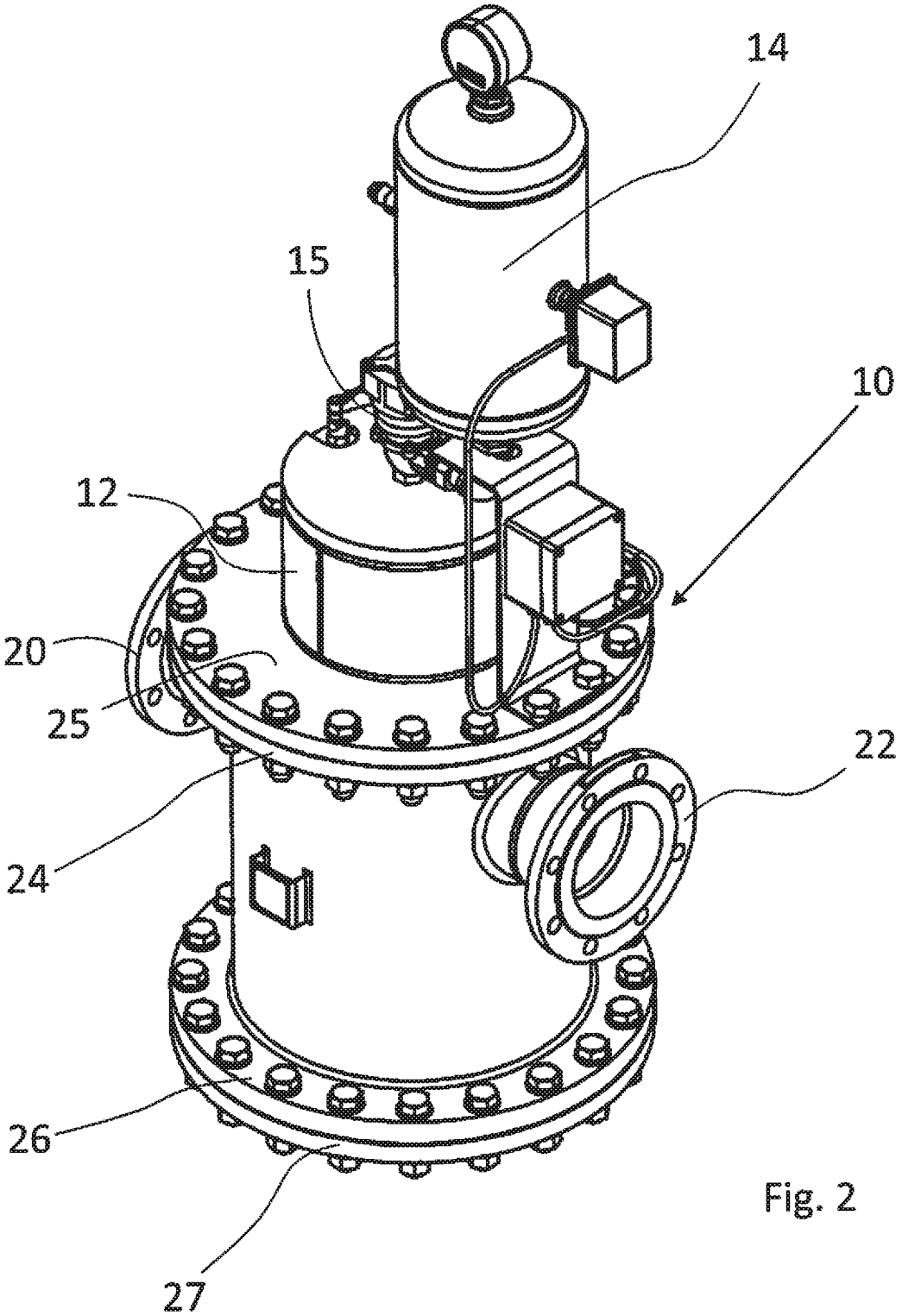

FIG. 2 shows a perspective view of the extinguishing device 10 from FIG. 1. The supply flange 22 and the discharge flange 20 for connecting to the gas pipeline 2 can be clearly recognized. It also shows the cylindrical container 12, in which the extinguishing agent space 16 and the sealing fluid space 18 are arranged. The extinguishing agent space can be fluidically connected to the container 14 via a compressed gas pipeline, which features a quick action valve 15. The container 14 contains a compressed gas. It is also clear that the extinguishing device 10 has a cover 25 and a base 27, wherein each of these is connected via a cover flange 24 and a base flange 26 to a cylindrical housing, in which the inner space 4 and the outer space 6 are situated.

The container 12 and the container of compressed gas 14 are preferably securely connected to the cover 25. Specifically, this renders it possible to replace the cover 25, along with the container 12 and the container 14, in order to restore the operational capability of the extinguishing device 10. To this end, the membrane 8 is preferably arranged in the middle of the cover 25. The cover flange 24 preferably features a recess that corresponds to the membrane 8. In particular, this renders it possible to also replace the destroyed membrane 8 by replacing the cover 25. Any works inside the extinguishing device 10 are thus rendered obsolete.

Figure 3:
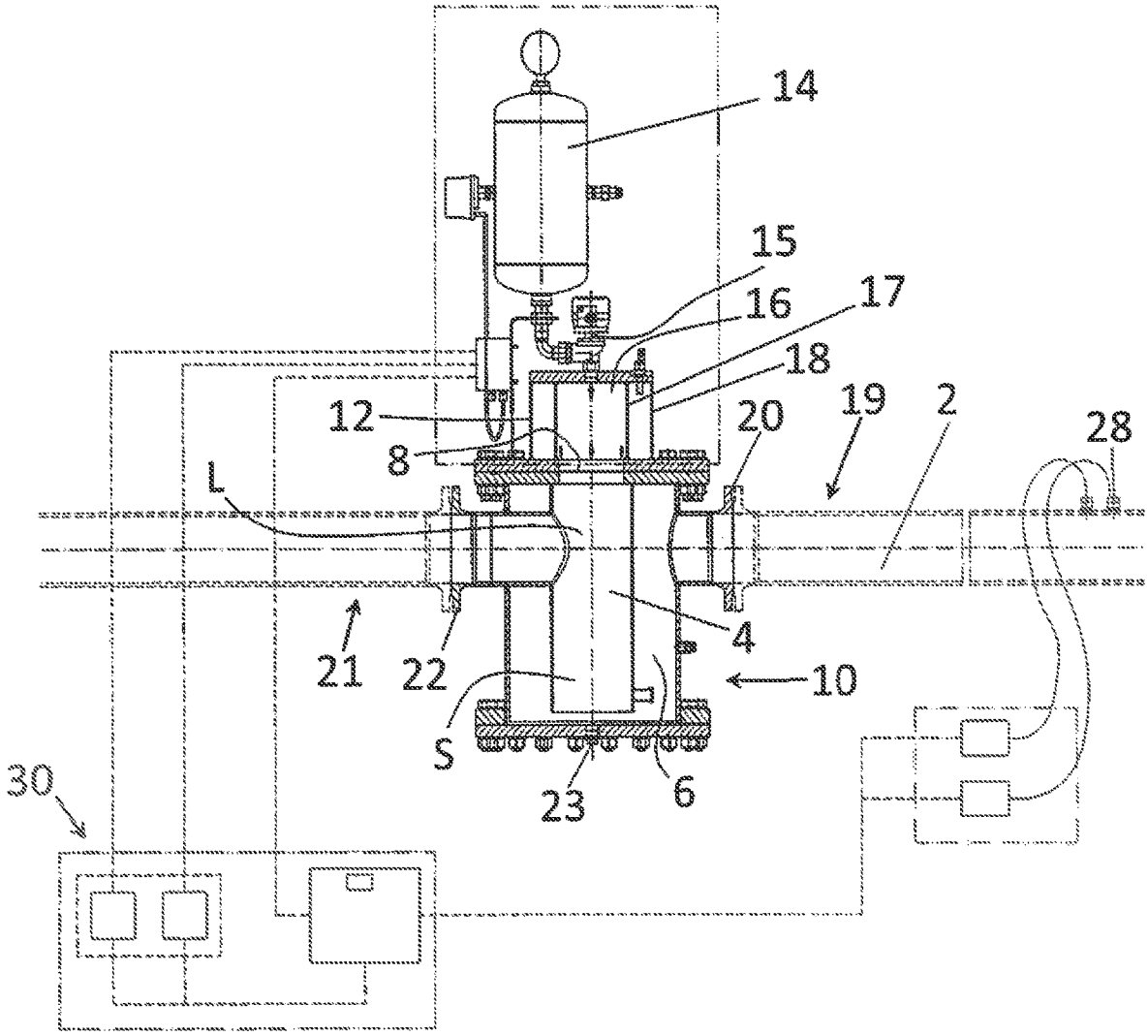

FIG. 3 depicts the extinguishing device 10 from FIGS. 1 and 2, having been integrated in a gas pipeline 2. Unlike in FIG. 1, the supply flange 22 is shown on the left-hand side and the discharge flange 20 on the right-hand side of the extinguishing device 10 shown in FIG. 3. In FIG. 3, gas thus flows the extinguishing device 10 from left to right and a flame front in the opposite direction, i.e. from right to left.

FIG. 3 shows that the extinguishing device 10 is connected to supply section 21 of the gas pipeline 2 via a flange that corresponds to the supply flange 22. The discharge flange 20 is connected to a discharge section 19 of the gas pipeline 2 via a corresponding flange. Detectors 28 are arranged in the discharge section 19 of the gas pipeline 2. These detectors are allocated to the extinguishing device 10 and configured to detect a flame front. For example, this may refer to spark detectors. The detectors 28 send detector signals, which for instance code in the event of a detected spark or a detected flame front, to an electronic control device 30. Using these detector signals, the electronic control device 30 controls the quick action valve 15. For example, if one of the detectors 28 detects a flame front in the gas pipeline 2, it sends corresponding detector signals to the electronic control device 30. This then controls the quick action valve 15 and opens it. The time at which this opening occurs is also determined, for instance, by way of a distance of the respective detector 28 from the extinguishing device 10. The opening of the quick action valve 15 initiates the previously described extinguishing process.

REFERENCE LIST

2 gas pipeline
4 inner space
6 outer space
8 membrane
10 extinguishing device
12 container
14 container of compressed gas
15 quick action valve
16 extinguishing agent space
17 perforated partition wall
18 sealing fluid space
19 discharge section
22 supply flange
21 supply section
20 discharge flange
23 drainage device
24 cover flange
25 cover
26 base flange
27 base
28 detector
30 electronic control system
L extinguishing zone
S sealing zone

The invention claimed is:

1. A method for extinguishing a flame front in a gas pipeline, comprising:

introducing an extinguishing agent at an overpressure into an extinguishing zone of the gas pipeline; and introducing a sealing fluid into a sealing zone of the gas pipeline such that the sealing fluid fills a bottom of the sealing zone atop a bottom surface of the sealing zone and remains in the sealing zone because of the influence of gravity and in such a way that a gas flowing through the gas pipeline must flow into or out of the sealing zone via an opening which lies below a fluid level of the sealing fluid, such that the gas must flow through the sealing fluid in the sealing zone, wherein the bottom surface is lower than the opening, wherein the bottom surface is separate from the opening.

2. The method according to claim 1, wherein the sealing fluid introduced into the sealing zone prevents a movement of a flame front from one side of the sealing zone to another side of the sealing zone.

3. The method according to claim 1 wherein the sealing fluid is introduced into the gas pipeline sequentially after the extinguishing agent.

4. The method according to claim 1 wherein the extinguishing agent and the sealing fluid are the same fluid.

5. The method according to claim 1 wherein the extinguishing zone and the sealing zone at least partially coincide spatially.

6. The method according to claim 5 wherein either the extinguishing zone is completely part of the sealing zone, or the sealing zone is completely part of the extinguishing zone.

7. The method according to claim 1, further comprising opening a closure in order to introduce the extinguishing agent into the extinguishing zone.

8. The method according to claim 7 wherein the step of opening the closure is performed by either switching a valve or destroying a membrane.

9. The method according to claim 1 wherein the overpressure destroys a membrane that fluidically separates the extinguishing agent from the extinguishing zone, thereby permitting introducing the extinguishing agent into the extinguishing zone.

10. An extinguishing device for a gas pipeline, comprising:

at least one container for accommodating an extinguishing agent and a sealing fluid and is configured to conduct a method according to claim 1.

11. The extinguishing device according to claim 10, further comprising a container of compressed gas or a gas generator for generating the overpressure.

12. The extinguishing device according to claim 10 wherein the at least one container is configured to accommodate the extinguishing agent and the sealing fluid.

13. The extinguishing device of claim 10 wherein the at least one container comprises at least one extinguishing agent space and at least one sealing fluid space.

14. The extinguishing device of claim 13 wherein the at least one extinguishing agent space and the at least one sealing fluid space are fluidically connected or fluidically connectable to one another.

15. The extinguishing device according to claim 10 wherein the at least one container is configured to separately introduce the extinguishing agent into the extinguishing zone and the sealing fluid into the sealing zone.

16. The extinguishing device according to claim 10, further comprising:

at least one detector arranged or arrangeable in or on the gas pipeline, wherein the at least one detector is configured to detect a flame front; and an electronic control system.

17. The method according to claim 1, wherein the sealing fluid comprises water.

18. The extinguishing device of claim 10, wherein the sealing fluid comprises water.

* * * * *